US005106005A

United States Patent [19]

Waldrum

[11] Patent Number: 5,106,005

[45] Date of Patent: Apr. 21, 1992

[54] REUSABLE CARRIER FOR CONTAINERS

[75] Inventor: John E. Waldrum, Ambler, Pa.

[73] Assignee: Dow Elanco, Indianapolis, Ind.

[21] Appl. No.: 404,172

[22] Filed: Sep. 6, 1989

[51] Int. Cl.[5] ..... A45F 3/08

[52] U.S. Cl. ..... 224/210; 224/148; 224/261; 294/31.2; 294/27.1

[58] Field of Search ..... 224/259, 261, 202, 148, 224/209, 210, 214, 257, 258; 220/85 H, 320; 294/165, 31.2, 32, 27.1

[56] References Cited

U.S. PATENT DOCUMENTS

| | | | |
|---|---|---|---|
| 1,635,928 | 7/1927 | Davis | 224/209 |
| 1,681,150 | 8/1928 | Vischer, Jr. | 220/320 |
| 1,913,006 | 6/1933 | Smith | 224/148 |
| 2,013,950 | 9/1935 | Davidson | 224/148 |
| 2,162,057 | 6/1939 | Brandt et al. . | |
| 2,606,701 | 8/1952 | Huthsing | 224/210 |
| 3,095,123 | 6/1963 | Smith, Sr. et al. . | |
| 3,442,427 | 5/1969 | Arnell et al. | 224/261 |
| 3,496,349 | 2/1970 | Townsend | 220/320 |
| 4,116,374 | 9/1978 | Garello | 294/165 |
| 4,336,899 | 6/1982 | Price, II | 224/202 |
| 4,848,660 | 7/1989 | O'Connell | 224/259 |

*Primary Examiner*—Linda J. Sholl

*Attorney, Agent, or Firm*—Eckert Seamans Cherin & Mellott

[57] ABSTRACT

A reusable carrier for plastic containers is disclosed which includes a bent wire base of suitable dimensions and configuration to fit about and secure upon the bottom bead of the plastic container. A pivotal latch is provided to alternately secure and release the carrier base from association with the base bead of the container. An upper lifter is removably insertable into the finger space defined by the container handle to engage the plastic container handle in a releasable manner. First and second flexible carrying straps are affixed respectively to the upper lifter and to the carrier base to permit a filler container to be readily lifted and carried upon the back of the operator. The carrier base and carrier lifter are preferably formed of bent and welded wire components to minimize both the weight of the carrier and the fabrication costs.

24 Claims, 4 Drawing Sheets

12
14
16
18
20
24
26
28
30
32
34
36
38
42
44
48
50
52
56
60
66
68
70
72
74
76
78
98
100
10

REUSABLE CARRIER FOR CONTAINERS

BACKGROUND OF THE INVENTION

1. Field of the Invention

This invention relates generally to the field of manually applying liquid herbicides, insecticides, fungicides, pesticides and fertilizers to ground surfaces, plants and the like, and more particularly, relates to a low cost apparatus suitable to enable a worker to carry and use a factory filled agricultural liquid container without first requiring the transfer of the liquid to a separate container.

2. Discussion of the Prior Art

There are numerous known types of applicator devices which have been developed for the direct application of liquid agricultural materials such as herbicides, insecticides and plant growth regulators by an agricultural field worker. For example, in U.S. Pat. No. 2,162,057, Brandt, et al disclose a knapsack sprayer which comprises generally a liquid container which is intended to be worn on the back of a field worker to allow the worker to carry liquid chemicals comfortably into the field for spraying purposes. Straps are provided which snap upon lugs formed in the carrier and the straps are arranged to extend over the shoulders and under the arms of the operator so that the container can be conveniently worn and carried on the back of the operator.

In the device of U.S. Pat. No. 2,162,057, a container or tank is provided with a cover which is openable prior to use to permit the liquid to be sprayed to be poured into the container for subsequent field application. Such agricultural liquids are usually packaged and shipped in disposable plastic bottles of convenient size for handling, such as two and one-half gallon or ten liter capacity. After emptying the contents of the plastic bottle into the tank carried by the field worker, the empty container was usually discarded, thereby resulting in single and inefficient use of a relatively strong and costly package.

In U.S. Pat. No. 3,095,123, Smith, Sr., et al disclose a tank having a perforated shield or insulator for preventing the cold wall of the tank from directly contacting the operator. Carrying straps having conventional snap hooks extend from the tank to facilitate carrying the filled container upon the back of the worker or operator. The supply tank of Smith, Sr., et al is designed and intended to be repeatedly refilled and reused to thereby assure an extended life cycle for the apparatus to permit the application of a wide variety of liquid chemical preparations. No mention is made to reusing the original agricultural liquid shipping container.

The presently available agricultural liquid applicators are generally efficient when in use and do enable a single worker to repeatedly employ the equipment upon refilling the container with the required agricultural liquids. However, such equipment is designed to be refilled and reused and consequently, is subject to abuse and to accidents. No provisions have been made by the prior workers in the art to utilize the original shipping containers in a manner to provide increased efficiency and to minimize plastic bottle disposal problems. The prior art spraying systems can be relatively expensive in nature and subject to frequent damage, thereby materially increasing equipment costs. Accordingly, there remains a need to supply a rugged, inexpensive and easily usable container carrying device that may be simply used repeatedly with agricultural liquid shipping containers to thereby maintain equipment capital costs for field spraying to the absolute minimum.

SUMMARY OF THE INVENTION

The present invention relates generally to containers for carrying liquid and other agricultural chemicals in the field, and more particularly, is directed to an extremely low cost, simply constructed and easily used carrier that is suitable for reuse with a plurality of similarly configured agricultural liquid shipping containers.

The reusable carrier of the present invention is particularly designed for manual use and for carrying by a single individual without the need for associated vehicles or other machinery or mechanisms. The reusable carrier comprises essentially a wire base of configuration suitable to encircle and clamp about the bottom of a plastic agricultural liquid shipping container in an easily secured and easily openable manner. A pair of adjustable, flexible carrying straps can be releasably affixed to spaced loops provided on the carrier base by utilizing snap hooks or similar attaching means in well known manner. An upper hanger or lifter includes an upper web and integral, depending engagement legs of suitable configuration to removably secure to the liquid container at the usual integral, upper handle. The web of the upper hanger or lifter includes an integral loop to which the upper ends of the flexible carrying straps are permanently affixed.

It is an important feature of the present invention to provide the base with easily openable latch means whereby the base can quickly be secured about the bottom bead of the liquid container when it is desired to carry the liquid container into the field for spraying purposes. After the liquid contents of the container have been completely sprayed or otherwise dissipated by the worker or operator in the usual manner, by opening the carrier base latch means and by removing the upper hanger or lifter from association with the container carrying handle, the empty container can be quickly discarded and a new, filled container can be fitted with the same reusable carrier to permit the operator to continue on with his work without any lost time that might have otherwise been required for refilling the container.

It is contemplated that both the carrier base and the carrier upper hanger will be fabricated of inexpensive bent and welded wire components which are rugged in construction and extremely inexpensive in material cost and in manufacture. Accordingly, the reusable carrier of the present invention could even be considered as a give-away item which could be furnished free to a user upon purchase of one or more containers filled with the agricultural liquid chemicals. The reusable carrier is designed and intended for use with a plurality of containers of the same configuration whereby a single carrier will be reusable only with subsequent containers furnished by the manufacture of the original container. Accordingly, the reusable carrier serves as an incentive for a worker or his employer to subsequently use only containers and chemicals furnished by the original manufacturer.

It is therefore an object of the present invention to provide an extremely simple, low cost and reusable carrier for containers of the type set forth.

It is another object of the present invention to provide a novel reusable carrier for agricultural liquid containers comprising a container encircling base having operable latch means for releasably affixing the carrier base to the base bead of a plastic container or bottle, an upper hanger adaptable to be readily engaged with and removed from the top carrying handle of the container and strap means intermediate the carrier base and the carrier upper hanger to facilitate carrying the filled container upon the back of a worker.

It is another object of the present invention to provide a novel reusable carrier for a container of the type having a base bead and a top handle comprising a carrier base means to releasably engage the container at the container base bead, upper hanger means to engage the container at the top carrying handle and strap means connected intermediate the upper hanger means and the carrier base means to permit a worker to easily carry the container upon his back for field application of the liquid contents of the container.

It is another object of the present invention to provide a novel reusable carrier for agricultural liquid containers that is inexpensive in manufacture, repeatedly reusable with a series of previously filled containers and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
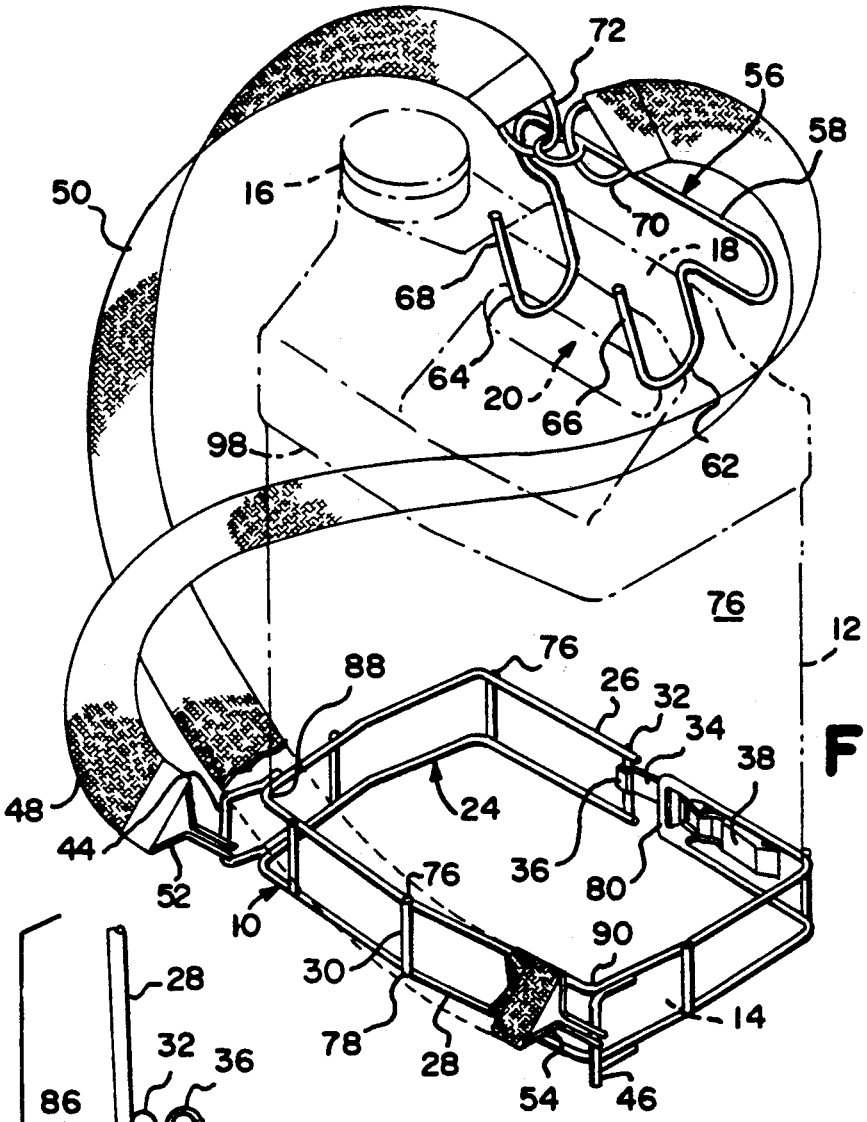
FIG. 1 is a perspective view showing the reusable carrier of the present invention, the carried container being shown in phantom lines for purposes of association.

Although specific terms are used in the following description for the sake of clarity, these terms are intended to refer only to the particular structure of the invention selected for illustration in the drawings, and are not intended to define or limit the scope of the invention.

Referring now to the drawings, there is shown in FIG. 1 a container carrier 10 constructed in accordance with the teachings of the present invention in use with a usual type of plastic liquid container 12. The container 12 may conventionally be blown, molded or otherwise formed to the desired capacity and configuration. In the illustrated embodiment, the plastic container 12 is preferably of two and one-half gallons or ten liters in capacity to thereby limit the total weight and to permit the filled container to be easily transported to the job site and to be readily carried by a single operator 74 when the device is in use.

As shown, the plastic container 12 is designed of generally rectangular cross sectional configuration and comprises an integral, top handle 18 and an upper filling and dispensing opening which can be closed by a conventional, removable, threaded cap 16. The top handle 18 is preferably medially positioned relative to the center line of the plastic container 12 whereby the container 12 and its liquid contents will be substantially balanced when lifted at the top handle 18 by the reusable carrier 10 for subsequent field use. The top handle 18 defines a finger receiving cavity or carrying opening 20 above the container body 98 in well known manner and in accordance with usual plastic bottle blow molding techniques. A slightly outwardly extending peripheral base or bead 14 is formed near the bottom of the plastic container 12. The bottom or base bead 14 extends somewhat outwardly of the container sidewalls 100 for strengthening and stability purposes in accordance with conventional plastic bottle fabricating procedures.

Figure 2:
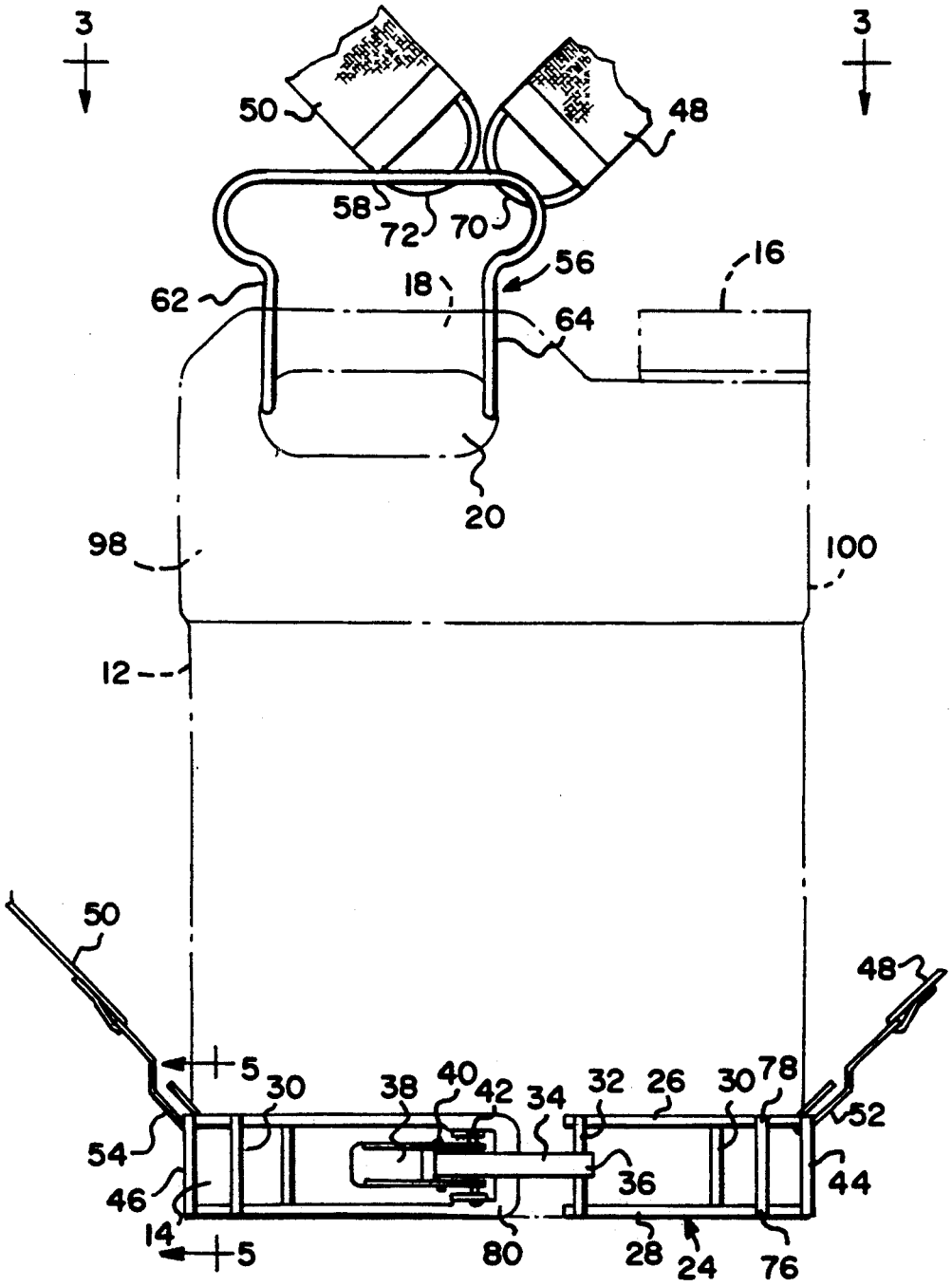
FIG. 2 is a front elevational view of the reusable carrier of FIG. 1 with the associated container to be carried shown in phantom lines.
Figure 3:
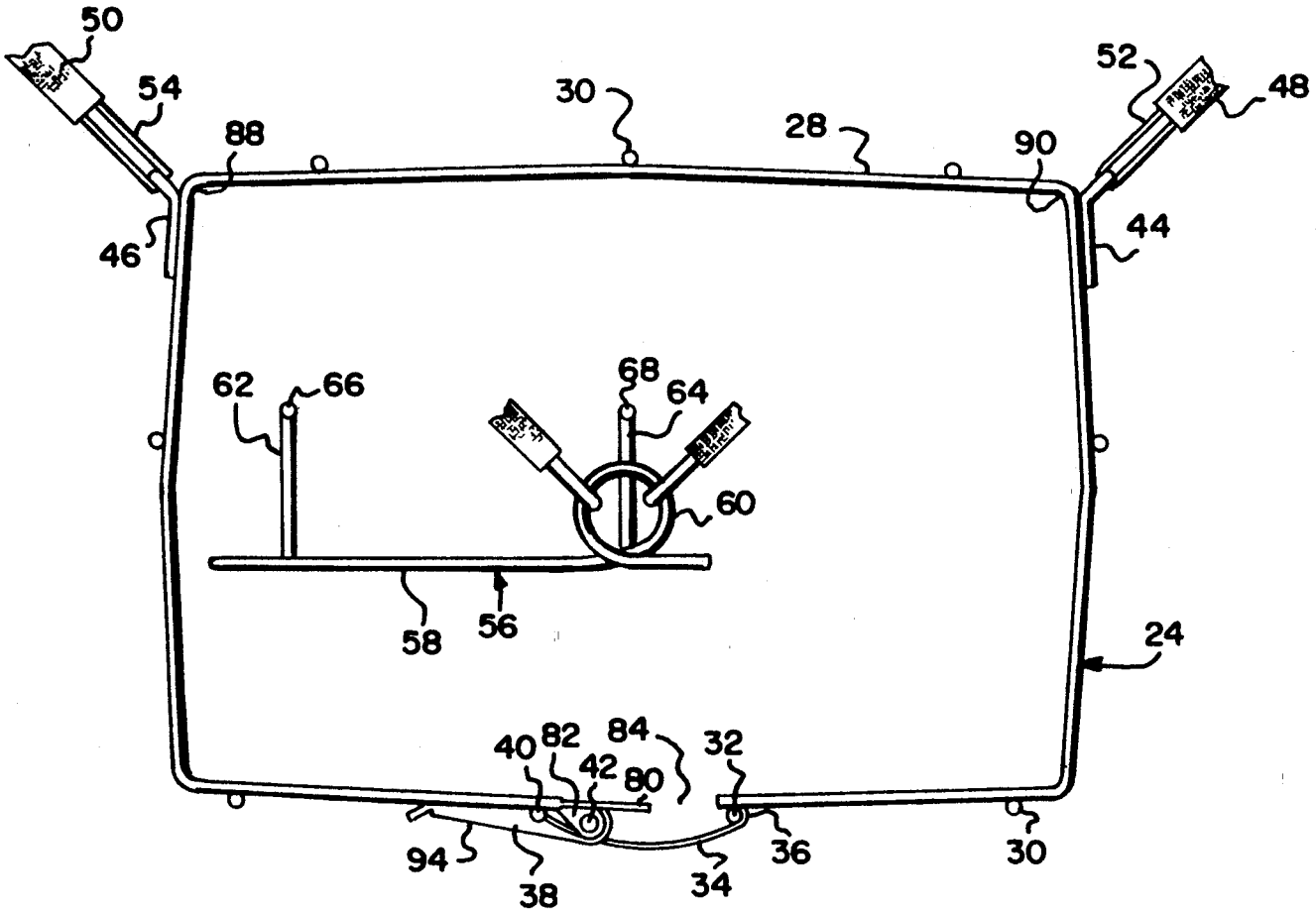
FIG. 3 is a top plan view of the container carrier looking from line 3—3 on FIG. 2 in the direction of the arrows.
Figures 4, 4A, 7:
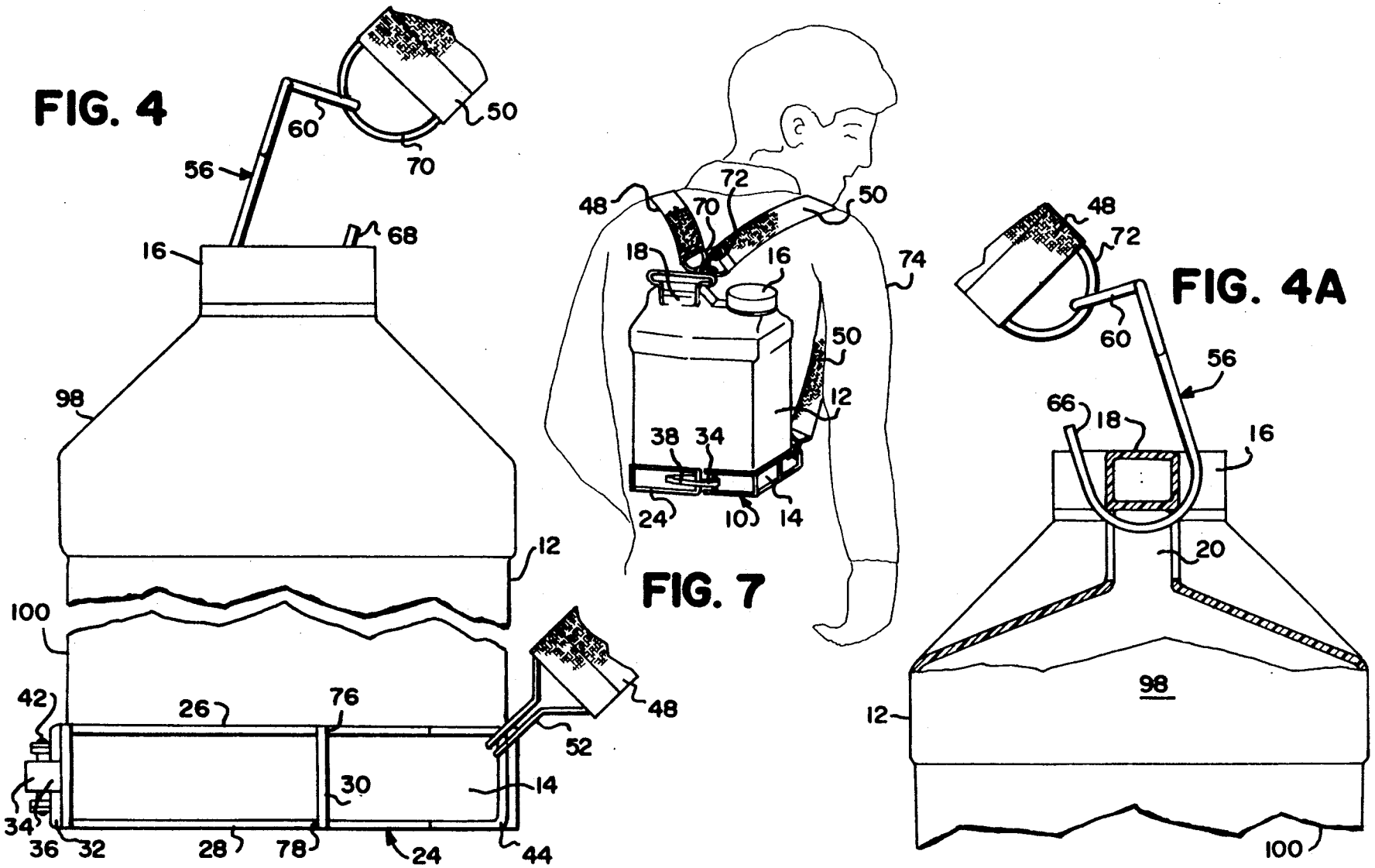
FIG. 4 is a right side elevational view of the container carrier and container.
FIG. 4A is a partial, left side elevational view of the container carrier and container, and partly broken away to expose interior construction features.
FIG. 7 is a perspective view, on reduced scale, showing the reusable carrier in use.

Referring now to FIGS. 2, 3 and 4, the reusable carrier 10 comprises generally a hollow rectangular base 24 of size and configuration to fit about and to secure over the base bead 14 of the plastic container 12. The carrier base 24 comprises an upper band or wire 26 and a spaced, parallel, lower band or wire 28, which wires are permanently secured in spaced relationship by a plurality of peripherally spaced vertical connectors 30. In the preferred embodiment, the upper and lower wires 26, 28 and the vertical connectors 30 are fabricated of metallic wire of suitable strength and diameter for the purpose. The parts 26, 28, 30 can be attached together in a series of upper and lower weld joints, e.g., 76, 78 to provide a permanent, low cost and sturdy base construction. As illustrated, the vertical connectors 30 are welded exteriorly to the upper and lower bands or wires 26, 28 so as not to interfere with the tight engagement of the upper and lower wires 26, 28 over the plastic container base or bead 14 in the manner hereinafter more fully discussed.

The upper and lower wires 26, 28 terminate at one end in a vertical end locking connector 32 for interlocking engagement with the hook 36 of a pivotal spring latch 34. The opposite ends of the upper and lower wires 26, 28 terminate in a latch band 80 to which a metallic, elongated operator lever 38 is pivotally affixed by employing an operator pivot pin 42. The spring latch 34 in turn is pivotally secured to the operator 38 by a latch pivot pin 40. The latch pivot pin 40 as illustrated is positioned in spaced relation to the operator pivot pin 42 to thereby provide a latching distance 82 therebetween for base securing purposes as hereinafter more fully set forth.

A pair of left and right strap retaining loops 44, 46 are welded or otherwise securely affixed in known manner respectively to the upper and lower bands or wires 26, 28 at the corners 88, 90 of the carrier base which are remote from the spring latch 34. First and second flexible carrying straps 48, 50 are provided with conventional strap engagement hooks or snap fasteners 52, 54 to permit releasable engagement of the straps 48, 50 with the carrier base 24 at the left and right strap retaining loops 44, 46 to facilitate carrying of the filled plastic container 12 upon the back of an operator or worker 74. Inasmuch as it is intended that the straps 48, 50 will always remain associated with the carrier base 24 and that numerous separate plastic containers 12 will be serially used and then discarded when empty, the ends of the flexible straps 48, 50 may be permanently interconnected with the strap loops 44, 46 if so desired, without interfering in any manner with the repeated or reusable operation of the container carrier 10.

A separate, upper hanger or lifter 56 can be bent or otherwise formed of a sturdy length of wire to define a top web 58 and a pair of integral, depending, plastic container handle engagement legs 62, 64. The engagement legs 62, 64 may be generally J-shaped in configuration and are sized to fit beneath the container top handle 18 and through the finger opening or space 20 to provide a secure, yet easily releasable engagement between the upper lifter 56 and the container 12. The top web 58 preferably can be integrally bent to provide a sturdy, strap connector loop 60 to receive and engage the strap connector rings 70, 72 which are respectively provided at the ends of the flexible carrying straps 48, 50 for container lifting and carrying purposes. See FIGS. 1 and 3. If desired, the strap connector rings 70, 72 can be interconnected.

Figure 6:
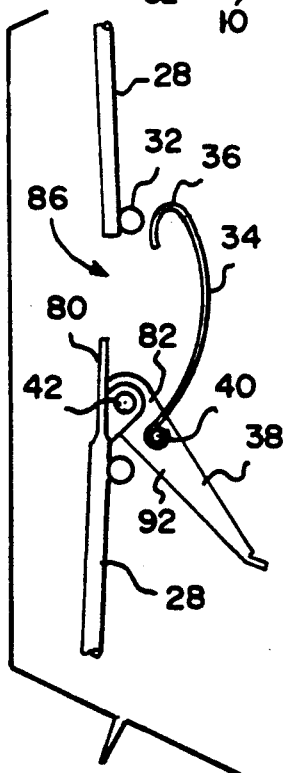
FIG. 6 is an enlarged, partial, top plan view of the reusable carrier latch, showing the operating parts in open condition.

In order to use the carrier 10 of the present invention, the spring latch 34 should be opened by pivoting the operator lever 38 to its open or unlatched position 92 as illustrated in FIG. 6 to define a large opening 86 between the pivoted end of the latch band 82 and the end locking connector 32. When the parts are opened to the position illustrated in FIG. 6, the carrier base 24 will be larger in peripheral dimensions than the outer periphery of container sidewalls 100 so that the carrier base 24 can be readily applied about the base bead 14 of the plastic container or bottle 12. With the operator lever 38 in its open position 92, the upper band or wire 26 can be applied about the upper extent of the base bead 14 and the lower band or wire 28 is positioned about the bottom extent of the base bead 14 of the plastic container 12. See FIG. 5.

Figure 5:
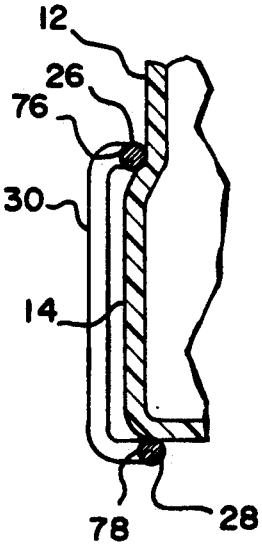
FIG. 5 is an enlarged, partial, cross section view of the reusable carrier base, looking from line 5—5 on FIG. 2 in the direction of the arrows.

The latch hook 36 can then be engaged over the end locking connector 32 and the pivotal operator lever 38 can then be urged toward its locking position 94 as illustrated in FIG. 3. This will cause the pivotal operator lever 38 to pivot or rotate about its pivot pin 42 to thereby pull or lock the open ends of the carrier base 24 together, thereby defining a smaller opening 84 between the parts 80, 32 to tightly secure the carrier base 24 to the base of the plastic container 12 about the bottom bead 14 thereof. The upper and lower peripheries of the base bead 14 and the upper and lower bands or wires 26, 28 of the carrier base 24 lock together as illustrated in FIGS. 3 and 5 whereby the latched carrier base 24 cannot become disassociated from the plastic container 12 at the base bead 14 thereof until the operator lever 38 is opened or pivoted to its open position 92, thereby unlatching the spring latch loop 36 from its engagement with the end locking connector 32.

The upper hanger or lifter 56 can be easily engaged with the upper handle 18 of the plastic container 12 by simply inserting the J-shaped hooks 66, 68 into the finger opening or space 20 and then rotating the lifter 56 as necessary to face the web 56 upwardly above the handle 18. With the upper hanger or lifter 56 so positioned, the first and second flexible straps 48, 50 can be placed over the shoulders of the operator or worker 74 in the usual manner so that a filled, plastic container 12 can be comfortably carried upon the back of the worker for direct application of the liquid contents (not shown) to the desired areas to be treated.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but only by the scope of the claims appended hereto.

What is claimed is:

1. A reusable carrier for interchangeably receiving containers of standardized configuration having a hollow body, a bottom peripheral bead protruding from walls of the containers, and an upper handle defining a finger opening, the carrier comprising:

a carrier base means sized to fit about and secure against the container only at the bottom peripheral bead, the carrier base means comprising a first, variable peripheral length and first and second ends defining a variable opening therebetween, the carrier base means having upper and lower bands spaced vertically and rigidly attached together, the bands extending around a periphery of the carrier base means so as to engage the container inwardly, immediately over and under the bottom peripheral bead;

latch means affixed to the first end of the carrier base means and being removably attachable to the second end of the carrier base means, the latch means being engaged to the carrier base means for simultaneously moving both the upper and lower spaced bands into and out of engagement with the bottom peripheral bead, the latch means being movable between discrete latched and unlatched positions, namely a first, unlatched position wherein the opening is of a first, large size and a second, latched position wherein the opening is drawn to a smaller size, the large size being dimensioned for passing the carrier base means over the peripheral bottom bead and the smaller size being such as to cause the carrier base means to engage on the bottom peripheral bead;

a carrier hanger means spaced above the carrier base means, the carrier hanger means comprises at least one engagement leg, the engagement leg being adaptable to engage under the upper handle of the container; and first and second strap means interconnected between the carrier base means and the carrier hanger means, the carrier base means and the carrier means being unconnected apart from the strap means, said carrier base means, carrier hanger means and strap means forming a backpack together with the container when attached thereto, the container providing sole structural support for positioning ends of the strap means, whereby the container can be lifted and carried upon the back of a worker by utilizing the strap means.

2. The reusable carrier of claim 1, wherein the upper and lower bands are rigidly connected by a plurality of connectors.

3. The reusable carrier of claim 2, wherein the carrier base means comprises sides defining a generally rectangular configuration, and wherein the connectors are laterally spaced about the sides.

4. The reusable carrier of claim 1, wherein the latch means comprises an operator lever, the operator lever pivotally connecting to the first end of the carrier base means in a first pivot connection.

5. The reusable carrier of claim 4, wherein the latch means further comprises a spring latch, the spring latch comprising a hook, the hook being adapted to releasably engage the second end of the carrier base means.

6. The reusable carrier of claim 5, wherein the latch means is connected to the operator lever in a second pivot connection.

7. The reusable carrier of claim 6, wherein the first pivot connection is laterally offset from the second pivot connection, the first and second pivot connections defining a latching distance therebetween.

8. The reusable carrier of claim 7, wherein the bottom container bead defines a second peripheral length, said first, variable peripheral length of the carrier base means being greater than the second peripheral length of the container bead when the latch means is moved to its said first, unlatched position.

9. The reusable carrier of claim 8, wherein said first, variable peripheral length of the carrier base means is substantially equal to the second peripheral length of the container bead when the latch means is moved to its said second, latched position.

10. The reusable carrier of claim 1, wherein the engagement leg is generally J-shaped in configuration and wherein a portion of the engagement leg is adapted to be positioned within said container finger opening.

11. The reusable carrier of claim 1, wherein the carrier hanger means comprises an upper web and a pair of depending, laterally spaced, engagement legs, the engagement legs each being adapted for releasable engagement with the container handle.

12. The reusable carrier of claim 11, wherein the upper web comprises a loop and wherein the first and second strap means connect to the carrier hanger means at said loop.

13. The reusable carrier of claim 12, wherein the container has a center of gravity and wherein the loop is so positioned on the carrier hanger means so as to be located in substantial registry above said center of gravity.

14. The reusable carrier of claim 1, wherein the carrier base means comprises a pair of first and second strap connectors, the strap connectors being laterally positioned to define a transverse space therebetween about the width of a container to be carried.

15. The reusable carrier of claim 14, wherein the first strap means connects to the carrier base means at the first strap connector and the second flexible strap connects to the carrier base means at the second strap connector.

16. The method of carrying, upon the back of a worker, a filled container of the type comprising a hollow body, the body terminating upwardly in a handle and downwardly adjacent to the bottom thereof in a bottom peripheral bead, comprising the steps of:

encircling the bottom peripheral bead of the container with a carrier base having vertically spaced upper and lower bands which are rigidly attached together at a space corresponding to a width of said bottom peripheral bead, the upper and lower bands having free ends which can be drawn together to draw the carrier base inwardly;

securing the carrier base to the bottom peripheral bead by simultaneously latching together the free ends of the upper and lower bands so as to engage the upper and lower bands immediately over and under the bottom peripheral bead, using a latch having discrete locked and unlocked positions whereby the carrier base can be locked on the bottom peripheral bead and unlocked to disengage the bottom peripheral bead;

providing a hook shaped upper hanger and engaging the container handle by engaging a hook part of the upper hanger under the handle;

interconnecting a pair of flexible straps between portions of the carrier base and the upper hanger engaged with the container handle, such that the container is supported only the upper hanger, the straps and the carrier base, in the manner of a backpack having its structure defined by the container, the carrier base means and the carrier hanger means being unconnected apart from the strap means; and lifting and supporting the filled container by applying lifting forces on the flexible straps.

17. The method of claim 16, further comprising the step of utilizing as the upper hanger a hanger with a loop therein and interconnecting both flexible straps with the upper hanger at the loop.

18. The method of claim 16, further comprising forming the carrier base with a pair of vertically spaced upper and lower wires rigidly attached together by connectors.

19. The method of claim 16, wherein the filled container and the carrier are positioned adjacent the back of the worker and further comprising initially placing each strap respectively over a respective arm of the worker, thence over a respective shoulder of the worker and then using the carrier while so positioned.

20. A reusable carrier for containers of the type having a hollow body, a bottom peripheral bean and an upper handle defining a finger opening, the carrier consisting of:

a carrier base means sized to fit about and secure against the container only at the bottom bead of the container, the carrier base means comprising a first, variable peripheral length and first and second ends defining a variable opening therebetween, the carrier base means comprising upper and lower bands which are rigidly spaced to fit respectively immediately over and under the bottom peripheral bead of the container;

a latch affixed to the first end of the carrier base means and being removably attachable to the second end of the carrier base means, the latch being movable between discrete latched and unlatched positions whereby the upper and lower bands of the carrier base can be brought simultaneously into and out of engagement with the bottom bead of the container, the latch having a first, unlatched position wherein the opening is of a first, large size sufficient to pass over the bottom peripheral bead, and a second, latched position wherein the opening is of a smaller size, in the latched position the carrier base engaging only over the bottom bead of the container;

a carrier hanger means spaced above the carrier base means, the carrier hanger means comprising at least one engagement leg, the engagement leg being adaptable to engage the upper handle of the container; and first and second strap means interconnected between the carrier base means and the carrier hanger means;

whereby the container can be lifted and carried upon the back of a worker by utilizing the carrier base means to engage only at the bottom peripheral bead, the strap means to engage between the carrier base means and the upper handle of the container, and the body of the container as a sole rigid structural element between the carrier base means and the upper handle, the carrier base means and the carrier hanger means being unconnected apart from the strap means.

21. A carrying system, comprising:

at least one container of standard dimensions, having a hollow body, a bottom peripheral bead and an upper handle defining a finger opening, the container defining a substantially rigid structural element and the bottom peripheral bead protruding outwardly from the hollow body around a lower periphery of the container;

a carrier base means sized to fit about and secure against the bottom bead of the at least one container so as to attach removably to the hollow body immediately over and under the bottom peripheral bead, and to interchangeably receive additional said containers of said standard dimensions, the carrier base means comprising an upper band and a lower band which are rigidly spaced to correspond to a width of the bottom peripheral bead, the carrier base means defining length and first and second ends with a variable opening therebetween, the carrier base means defining a band which encompasses the container substantially only on the bottom peripheral bean;

a latch affixed to the first end of the carrier base means and being removably attachable to the second end of the carrier base means, the latch being movable between discrete latched and unlatched positions, namely a first, unlatched position wherein the opening is of a first, large size sufficient to enable the carrier base means to be passed over the bottom peripheral bead, and a second, latched position wherein the opening is of a smaller size, the latch being operable to simultaneously draw both the upper and lower bands inwardly over and under the bottom peripheral bead when moved from the unlatched position to the latched position, and operable to simultaneously move the upper and lower bands outwardly, for opening the carrier base means sufficiently to pass over the bottom peripheral bead, when moved from the latched position to the unlatched position;

a carrier hanger means spaced above the carrier base means, the carrier hanger means comprising at least one engagement leg, the engagement leg being shaped to engage under the upper handle of the container, and the carrier hanger means defining a point at which the carrier hanger means is engageable for bearing the weight of the container, the carrier hanger means engaging the container only under the handle; and first and second strap means interconnected between the carrier base means and the carrier hanger means;

wherein the carrier base means and the carrier hanger means provide a sole attachment to the container, the carrier base means and the carrier handle means being unconnected apart from the strap means, and the container defines a sole rigid structural member therebetween;

whereby the container can be lifted and carried upon the back of a worker by utilizing the strap means.

22. The carrier system according to claim 21, wherein the upper handle of the container is arranged over the center of gravity of the container and is asymmetrical to the center of gravity, and wherein the strap means are connected to the carrier hanger means at a point on the carrier hanger means over the center of gravity.

23. The carrier system according to claim 22, wherein the carrier hanger means defines a handle-shaped loop disposed above the container handle, for manually grasping the carrier hanger means above the container handle.

24. The carrier system according to claim 22, wherein the carrier hanger means includes two J-shaped legs for hooking under the container handle, the J-shaped legs being laterally spaced to reside in the finger opening.

* * * * *

UNITED STATES PATENT AND TRADEMARK OFFICE

CERTIFICATE OF CORRECTION

PATENT NO. : 5,106,005

DATED : April 21, 1992

INVENTOR(S) : John E. Waldrum

It is certified that error appears in the above-identified patent and that said Letters Patent is hereby corrected as shown below:

Column 6, line 56, before "means", insert the word --hanger--.

Column 8, line 39, "bean" should read --bead--.

Column 9, line 33, before "length", insert --a--.

Column 9, line 37, "bean" should read --bead--.

Signed and Sealed this

Seventeenth Day of August, 1993

*Attest:*

*Attesting Officer*

BRUCE LEHMAN

*Commissioner of Patents and Trademarks*